United States Patent [19]

Parks et al.

[11] Patent Number: 4,583,873

[45] Date of Patent: Apr. 22, 1986

[54] PRINTER WITH INTEGRAL PAPER HANDLING APPARATUS

[75] Inventors: Harville M. Parks, Austin; Philip W. Sobey, Georgetown; Bilson J. Wilson, Jr., Austin, all of Tex.

[73] Assignee: International Business Machines Corporation, Armonk, N.Y.

[21] Appl. No.: 617,763

[22] Filed: Jun. 6, 1984

[51] Int. Cl.[4] ..... B41J 11/58

[52] U.S. Cl. ..... 400/629; 400/624; 271/145; 271/170

[58] Field of Search ..... 400/624, 625, 628, 629, 400/622, 623, 626, 627; 271/19, 20, 21, 22, 145, 162, 163, 164, 167, 170; 101/232; 355/3 SH

[56] References Cited

U.S. PATENT DOCUMENTS

| | | | |
|---|---|---|---|
| 1,718,467 | 6/1929 | Labarre | 400/629 |
| 2,314,243 | 3/1943 | Potter | 400/624 |
| 4,164,376 | 8/1979 | Yarp | 400/612 |
| 4,192,498 | 3/1980 | Toto | 271/21 |
| 4,326,815 | 4/1982 | Kapp | 400/625 |
| 4,391,542 | 7/1983 | Baitz | 400/624 |
| 4,395,034 | 7/1983 | Fukui | 271/21 |
| 4,452,543 | 6/1984 | Adkisson et al. | 400/605 |
| 4,502,805 | 3/1985 | Humbs | 400/625 |

FOREIGN PATENT DOCUMENTS

81/00619 5/1981 PCT Int'l Appl. .

OTHER PUBLICATIONS

L. Adams, Jr., "Paper Feed System"; *IBM Tech. Disc. Bulletin,* vol. 24, No. 10, pp. 5028–5030, Mar. 1982.

*IBM Technical Disclosure Bulletin,* vol. 26, No. 4, Sep. 1983, pp. 1770–1771, "Document Separator", P. W. Sobey.

*Primary Examiner*—Edgar S. Burr

*Assistant Examiner*—David A. Wiecking

*Attorney, Agent, or Firm*—Andrea P. Bryant

[57] ABSTRACT

A printer with improved integral automated cut sheet feeding apparatus including a hopper (10) adapted to attach to bearing members on sheet picker roller (22), shaft (20), hopper (10) also including an upwardly biased sheet floor (58) being adapted to slidingly engage dual function corner restraint members (66) and to cooperate therewith to limit the stack size and reliably feed a single sheet properly oriented without requiring additional alignment means.

9 Claims, 9 Drawing Figures

PRINTER WITH INTEGRAL PAPER HANDLING APPARATUS

TECHNICAL FIELD

The present invention relates to improvements in automatic cut sheet feeding to a printer or other device using cut sheets. More specifically, the present invention relates to the provision of automatic cut sheet handling functions in a printer having utility in automated office information handling systems.

BACKGROUND ART

U.S. Pat. No. 4,395,034 to Fukui relates to a sheet feeding device comprising a cassette for holding a stack of sheets and feeding means for longitudinally advancing the uppermost sheet in the stack from the cassette into a using device. Separating pawl members are provided at the exit side of the cassette.

U.S. Pat. No. 4,326,815 to Kapp relates to a sheet feed device for use with a printer including a paper storage tray, paper drive and guide apparatus for feeding one sheet at at time from the paper storage tray to the platen of the printing device. Separate motive means are provided for separating the topmost sheet from the storage means and subsequently actuating the platen drive when the sheet has arrived at the appropriate place in the feed path.

U.S. Pat. No. 4,164,376 to Yarp describes a system for use in a high speed printer for permitting paper feed optionally through several paths.

International application PCT/US81/00619, published Nov. 11, 1982, Florida Data Corp. teaches a high speed printer having multiple paths for cut sheets fed automatically, singly inserted sheets, and continuous forms. The feed roll shaft is made integral with the printer but the sheet supply hopper is not attached thereto.

*IBM Technical Disclosure Bulletin,* Vol. 26, No. 4, September 1983, page 1770 to P. W. Sobey describes improved document separator rollers having a somewhat deformed D shape.

DISCLOSURE OF INVENTION

The present invention provides in combination improved apparatus for automatically feeding cut sheets from a paper holder tray having input and output sections through a transport path in a printer and back to the paper holder. The transport path as well as the separator mechanism for automatically extracting and feeding cut sheets from the input section is part of the printer. When it is not desired to feed cut sheets the sheet holder may be removed and manually fed sheets or continuous forms may be fed utilizing in part the same sheet feed/delivery path.

The cut sheet holder is designed to cooperate with the sheet transport apparatus in the printer. This arrangement differs substantially from some prior art devices providing the same function in that it is less complex, lighter weight and easier to manufacture, the above-mentioned aspects cooperating to enable lower overall cost.

The sheet holder includes novel corner restraint means for limiting the size of the stack of sheets in the input section of the sheet holder and for cooperating with the separator mechanism and other structure in the paper tray for reliably feeding one sheet at a time. Each sheet fed from the tray enters the feed/delivery path properly oriented so that no alignment apparatus is required.

The apparatus is designed for ease of manufacturability using automated assembly techniques as many parts merely snap into place.

BRIEF DESCRIPTION OF THE DRAWING

The invention will be described in greater detail having reference to the accompanying drawing wherein.

BEST MODE FOR CARRYING OUT THE INVENTION

Figure 1:
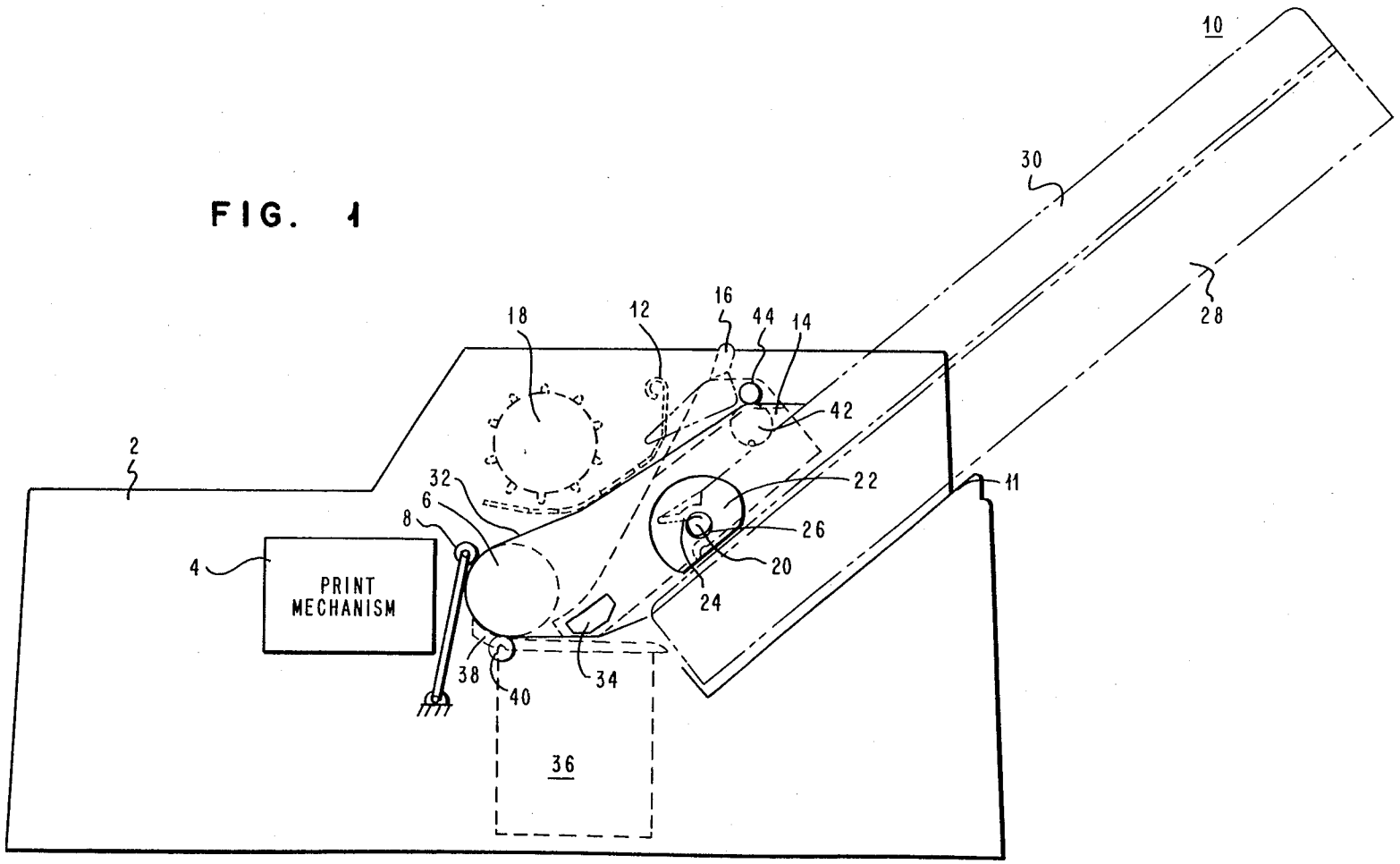
FIG. 1 is a cutaway side view cross section of a printer having integral paper handling apparatus in accordance with the present invention.

In the following description like parts are designated by like reference numerals throughout the several figures of the drawing.

FIG. 1 is a side cross section of a printer having in accordance with the invention, integral paper handling apparatus. Cut sheets may be manually inserted or automatically fed. Provision is made for a pin feed drive to feed marginally perforated continuous forms. The present invention relates specifically to the automatic cut sheet handling aspect of the printer.

The printer is generally designated by reference numeral 2. Printer 2 includes a print mechanism 4, the details of which form no part of the present invention. Print mechanism 4 is adapted for lateral movement along platen 6. Movable bail rollers 8 are provided to cooperate with platen 6 for advancing sheets therearound.

Cut sheets are supplied from two-section paper tray or hopper 10 which is adapted to be received in paper tray guide opening 11 of printer 2 and which will be described in greater detail in connection with FIG. 2. In the alternative, cut sheets may be manually inserted into the nip formed by upper and lower guides 12 and 14, respectively.

Single insert gate 16 pivots into a position to block the nip when sheets are to be fed automatically from hopper 10. Additionally, a path is provided for marginally perforated continuous forms and includes a pin feed drive 18.

Located between side frame members of printer 2 is a shaft 20 on which are attached for rotation therewith a pair of picker rollers 22. Integral with hopper 10 is a pair of clamp-like extensions 24 attached to shaft 20 by bushing members or bearing members 26. This feature of hopper 10 will be better understood having reference to FIG. 3.

Two-section hopper 10 maintains a supply of sheets to be printed in its lower section 28, and sheets which have been printed are returned to the upper portion 30.

A sheet extracted from the lower section 28 of hopper 10 is transported along a path defined by the heavy, solid line 32. Located near the exit area of hopper 10 in printer 2 is sensor 34 for detecting the presence of the leading edge of a cut sheet being fed. An internal printer frame member 36 includes sheet guide 38 and platen feed rollers 40 (one shown).

Figure 2:
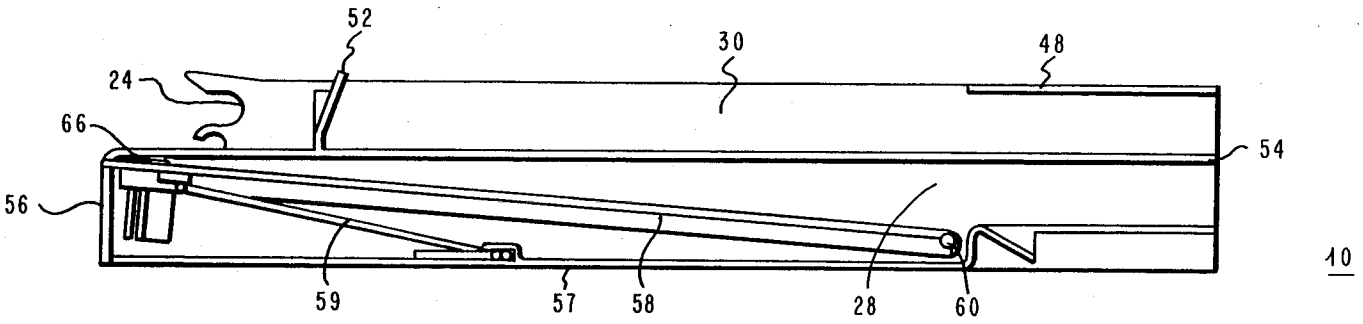
FIG. 2 is a cross sectional view of paper holder tray 10.
Figure 3:
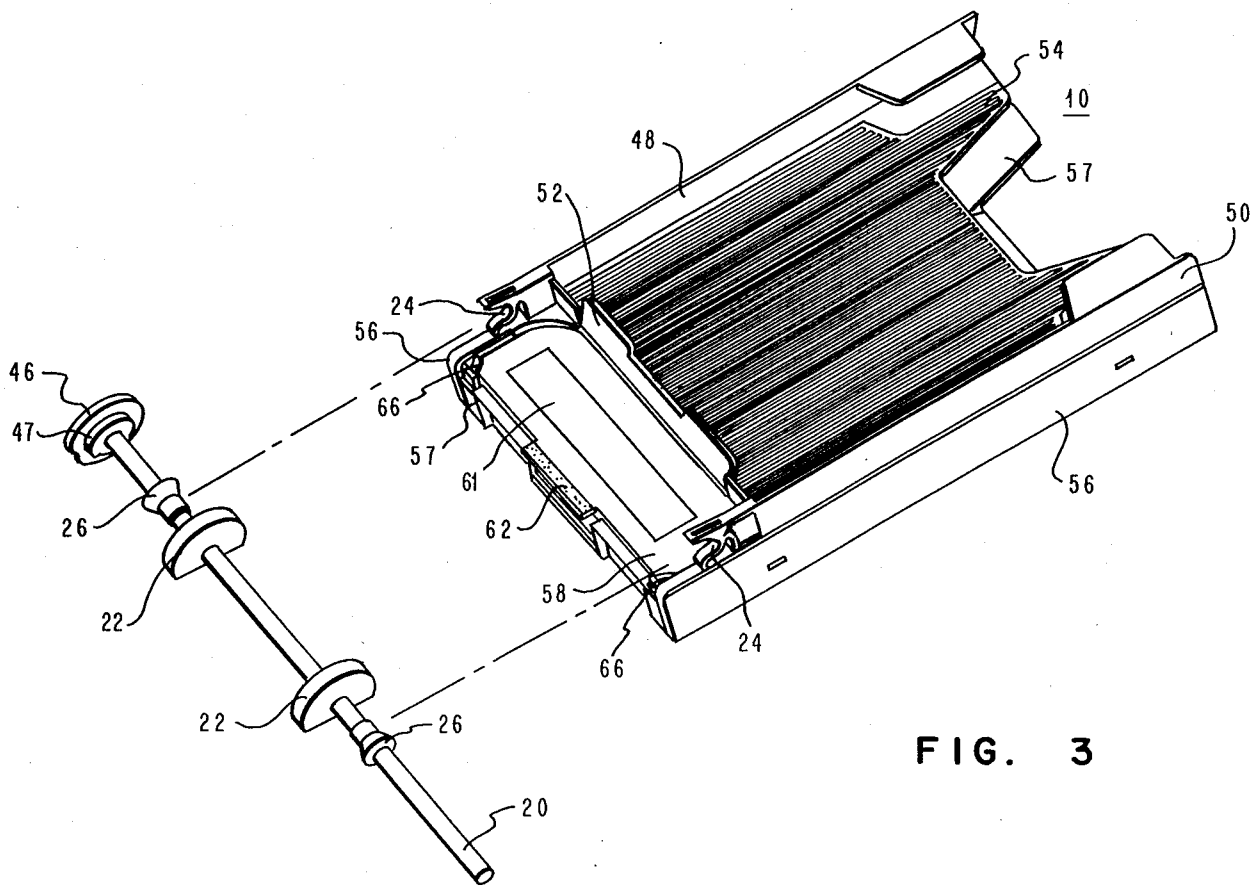
FIG. 3 shows the paper supply tray 10 and feed roll shaft 20.

Refer now to FIG. 2 which shows a linear cross section of paper hopper 10. The lower, supply section 28 is defined by the base 54 of output section 30 and base 57. The upper, output section 30 of paper hopper 10 is defined by walls 48, 50 (FIG. 3) and 52 and floor 54 and is provided for receiving printed sheets. Lower side walls 56 may be made integral with upper side walls 48 and 50 (FIG. 3). The lower, sheet supply section 28 includes a pivotally mounted floor 58 for supporting the stack of sheets to be fed. Spring 59 is provided for urging floor 58 upwardly, clockwise around point 60. Corner restraint members 66 are slidingly engaged in appropriately configured openings in floor 58. The rightmost end, opposite the exit area, of sheet hopper 10 is open, unrestrained; thus, sheets of varying lengths may be processed by the using device.

In FIG. 3 the bushings 26 attached to feed roll shaft 20 may be seen. They are sized to be engaged by appropriately, conformingly shaped clamps 24 which are made integral with hopper 10. Shaft 20 rotates in bushings 26 which are in a stationary contact with clamps 24 of hopper 10. Clutch gear 46 and its associated cam surface 47 are fixedly attached to shaft 20. The function of gear 46 will be explained having reference to FIGS. 7 and 8.

Support floor 58 of the lower, supply section 28 includes a resilient section 61 arranged to be in cooperating relationship with picker rollers 22. Picker rollers 22 are generally D-shaped but rollers such as those described in *IBM Technical Disclosure Bulletin,* "Document Separator", September 1983, Vol. 26 No. 4, page 1770, are particularly well suited for use in this apparatus.

Finger contact 62 is provided to facilitate lowering of stack support floor 58 when it is desired to replenish the supply of cut sheets. At its exit end beneath shaft 20, sheet stack support floor 58 is adapted to be engaged by corner restraints 66. Corner restraints 66 can be better appreciated recalling FIG. 2 and having reference to FIGS. 4, 5 and 6. Corner restraints 66 perform two functions, however, as will become clear as the description progresses. They determine the maximum supply stack size as well as facilitate the feeding of one sheet at a time.

Figure 4:
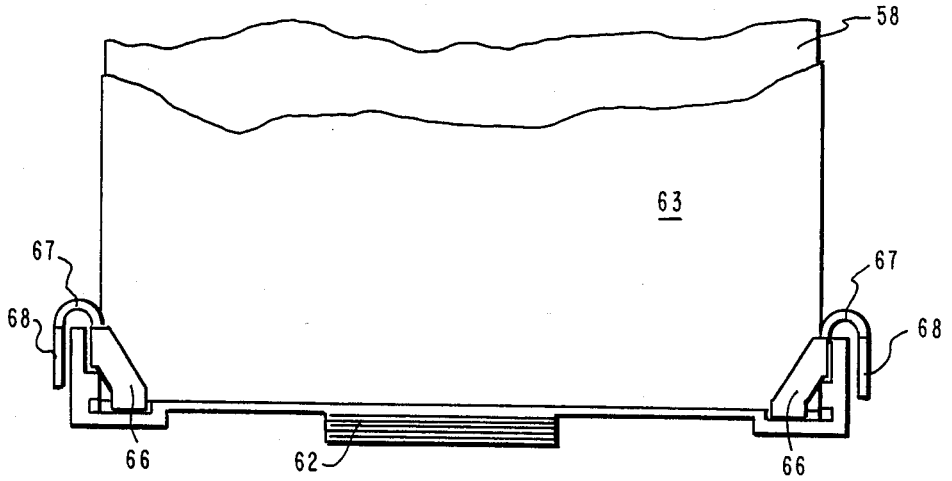
FIG. 4 is a top view of the exit area of supply tray 10.

Referring now to FIG. 4 therefor a top view of the sheet exit end of sheet support floor 58 and corner restraints 66. A stack of sheets 63 is in place. Corner restraints 66 are generally triangular in shape with one end extending to continue a generally U-shaped section 67. The arm of the U that is substantially perpendicular to the leg of the triangle perpendicular to the feed direction is longer than that part of corner restraint 66.

Figure 5:
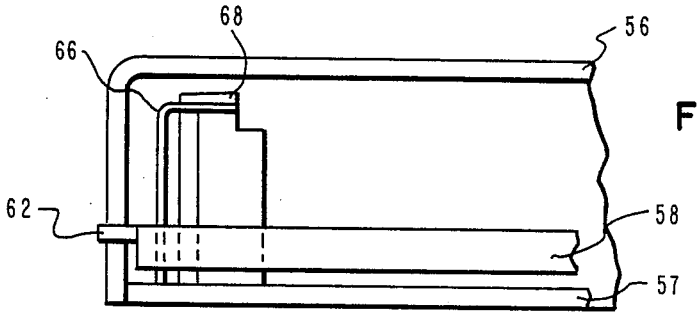
FIGS. 5 and 6 are side views of corner tab 66 from FIG. 4 without and with a sheet supply, respectively.

Looking now at FIG. 5 it is easier to see the upstop section 68 of corner restraint 66. Each section 68 is adapted to engage the interior of the overhand of side walls 56 to limit the upward travel of floor 58. FIG. 5 is a cross section of a portion of sheet hopper 10 with sheet support floor 58 in its lowermost position within side walls 56 of the lower section 28 of hopper 10. In its lowermost position floor 58 may contact base 57 of hopper 10 when filled with sheets to be fed or when held down by finger contact 62 for stack replenishment.

Figure 6:
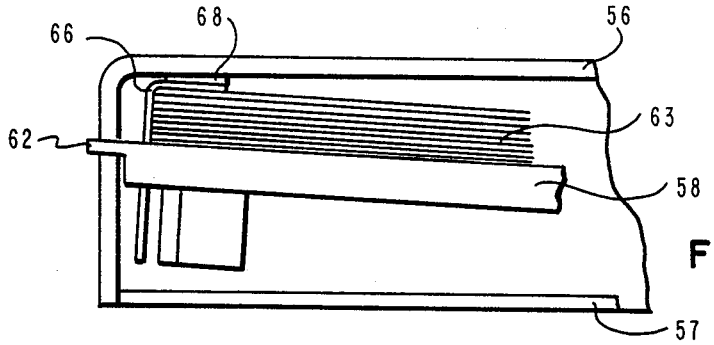

FIG. 6 is a view similar to FIG. 5 with the exception that sheet support floor 58 is in its upwardly biased position. The total height of corner restraints 66 including upstop section 68 is less than the depth of the area formed by the overhang of wall 56 and base 57. Referring back to FIG. 5, when floor 58 is in its lowermost position a stack of sheets may be inserted and the triangular section of corner restraint 66 which is parallel to floor 58 limits the height of stack 63. In FIG. 6, once the sheets are inserted and the upward bias of the spring 59 (FIG. 2) is exerted, upstop section 68 is engaged by the overhang of wall 56 and limits the upward movement of floor 58.

Figure 7:
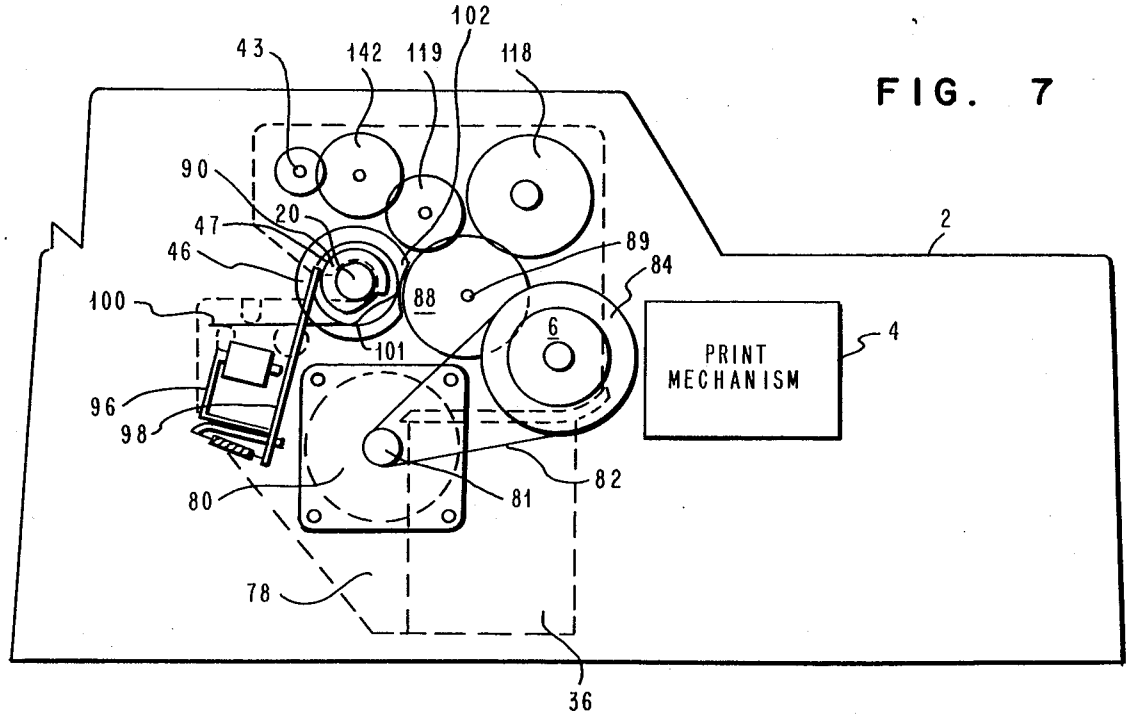
FIG. 7 is a schematic side view of the driving mechanism for initiating a paper input cycle.

FIG. 7 is a schematic side view taken through printer 2 of the driving mechanism for initiating a sheet feed cycle and the relationship of this mechanism to other parts of the sheet feed/delivery drive system. Printer internal frame 78 is partially shown in phantom. An index motor 80 is provided for precisely driving platen 6 through belt 82 trained around motor pulley 81 and pulley 84. All other driving connections are made through gearing from platen 6.

Also associated and integral with clutch gear 46 is latch surface 90. Gear 88 is provided for driving clutch gear 46 for selectively rotating picker roller shaft 20. Gear 88 also drives pin feed drive gear 118 associated with pin feed drive 18 and sheet feed idler gears 119 and 142. Idler 142 is adapted for driving output shaft 43 with which exit roller 42 (FIG. 1) rotates. Electromagnet 96 includes magnet armature 98 which cooperates with trip spring 100 for selectively allowing the clutch 46 to rotate picker roller shaft 20. The details of this arrangement are shown in FIG. 8.

Figure 8:
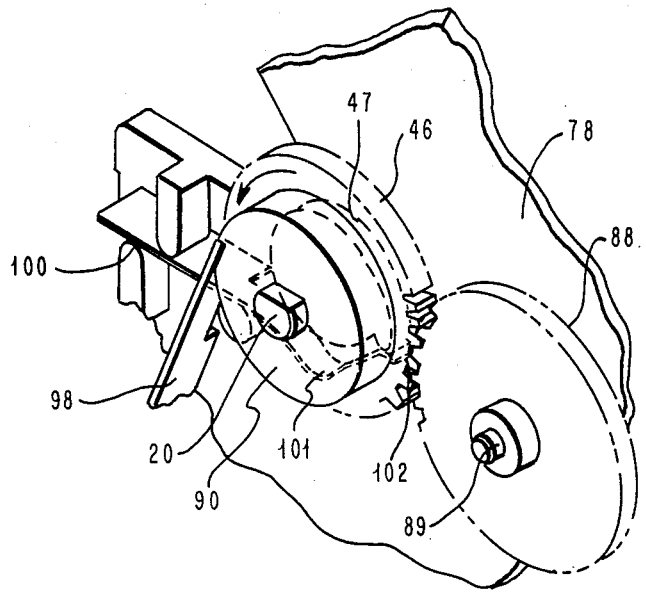
FIG. 8 is a detailed perspective view of clutch 90 from FIG. 7.

In FIG. 8 drive gear 88 for clutch 46 is shown attached to a stud 89 on internal printer frame 78. Clutch gear 46 is maintained in its home position by electromagnet armature 98 which contacts the clutch gear on latch surface 90. There is an undercut, untoothed, area 102 on clutch gear 46.

Upon receiving the appropriate electric signal, magnet armature 98 releases clutch gear 46 and clutch trip spring 100 causes clutch gear 46 to rotate counterclockwise until its teeth mesh with those of drive gear 88. Once clutch gear 46 rotates 360° its rotation is stopped when magnet armature 98 once again engages spring 100. Spring 100 includes a section 101 adapted to ride cam surface 47. This arrangement is shown for illustrative purposes only. It has the advantage of being easily adapted to automated assembly techniques. However, it is of course understood by those skilled in the art that other single cycle clutch designs would function as well.

Figure 9:
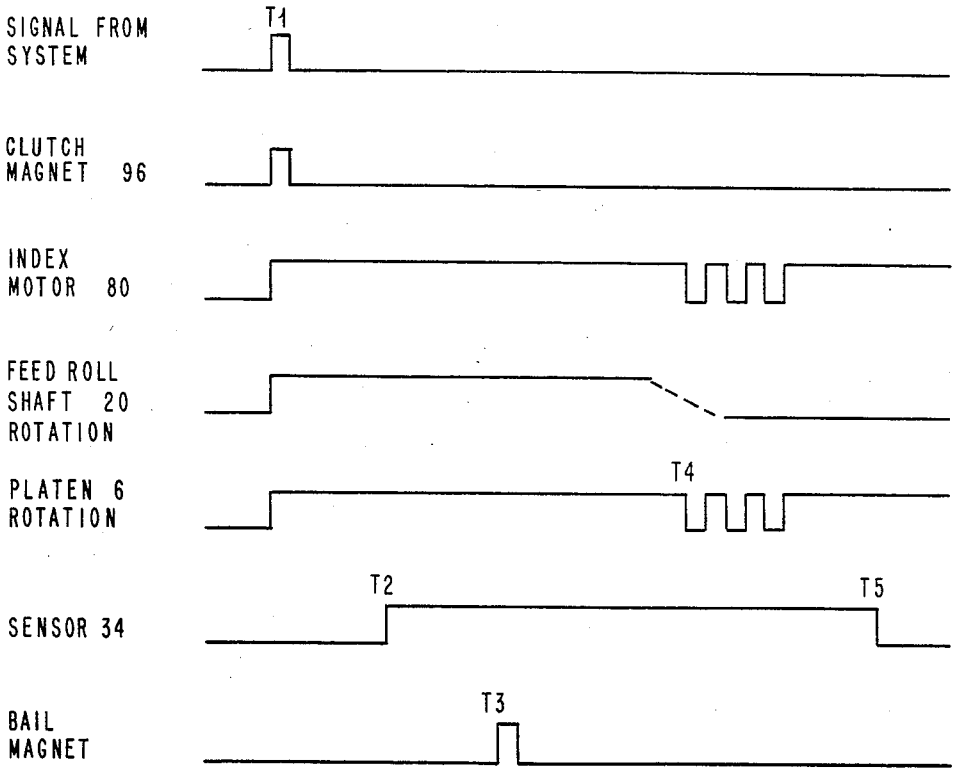
FIG. 9 is a timing diagram of a complete sheet feed/-delivery cycle.

The operation of the present invention will be described in conjunction with FIGS. 1, 8 and 9. At time 1 when it is desired to feed a sheet, a feed signal is generated in the system controls which is transmitted to electromagnet 96 in order to pick the picker roller shaft 20 magnet armature 98. As shaft 20 rotates in the clockwise direction in FIG. 1 picker rollers 22, which are normally maintained out of contact with the paper because their straight side is closest to the uppermost sheets in the stack, rotate bringing their curved sections into engagement with the uppermost sheet. As the picker rollers 22 contact the top sheet in the stack, the stack is depressed. The force of spring 59, FIG. 2, is transferred to the picker roller-sheet interface and provides the normal load necessary for generating a friction force between the picker rollers and the topmost sheet. As rollers 22 continue their rotation, the topmost sheet is buckled against corner tabs 66 and snaps over into feed path 32. Shaft 20 continues its rotation until picker rollers 22 reach their home position. At time T2 sensor 34 detects the arrival of the leading edge of the sheet. Platen index motor 80 is momentarily stopped, then restarted in order to precisely rotate a predetermined number of steps during the interval between T2 and T3 for determining when to operate the automatic bail 8 opener. A sheet is driven by rollers 22 at least past the nip formed by platen 6 and platen feed rollers 40. The leading edge then enters the nip formed between platen 6 and platen feed roller 40, following a path conforming to sheet guide 38. At time T3 the mechanism is actuated for opening bail 8. This mechanism, not shown in great detail, may be gearingly connected to the platen.

At time T3 the platen index motor 80 is again momentarily stopped, then restarted. The sheet is driven as the platen index motor 80 is again actuated and continues around the platen until time T4 when the platen 6 has rotated a fixed distance to place the sheet in the proper position for first printing. By time T4 picker rollers 22 have returned to their home position out of contact with the stack. Printing takes place in a conventional manner as platen 6 rotates and the sheet is guided into the exit feed path between upper guide 12 and lower guide 14 until it enters the nip formed by exit drive roller 42 and its backup roller 44. At time T5 the trailing edge of the sheet is detected by sensor 34. Platen index motor 80 continues to drive until the sheet is out of the exit path and in the output section 30 of hopper 10.

It may be noted that picker roller shaft 20 is preferably built into the printer 2, or other device which required cut sheets. It is, however, within the scope of the present invention that the feed shaft be built into a separate, self-contained apparatus for attachment to the using device. Appropriate driving means would be provided in that embodiment.

While the invention has been described having reference to a preferred embodiment and the above modification it will be understood that other changes in form and detail may be made without departing from the spirit and scope of the invention as described more specifically in the claims.

We claim:

1. Apparatus for feeding cut sheets one at a time from a stack of sheets to a using device feed path comprising:
- parallel side walls;
- a selectively rotatable shaft connected between the side walls, said shaft having bearing members thereon;
- sheet stack holder means removably mounted to the bearing members on the selectively rotatable shaft;
- sheet separator means mounted to the shaft; and
- means selectively connectable to the shaft for rotating the shaft.

2. The apparatus of claim 1 wherein the using device is a printer; and the
- means for rotating comprises a driven platen.

3. The apparatus of claim 1 wherein the means for rotating includes a motor operable in response to signals from the using device.

4. In combination, improved apparatus for supplying cut sheets one at a time from a stack of cut sheets to
- a printer including:
- side frame members in the printer;
- a platen connected between said side frame members;
- a print station located along the platen;
- means for feeding a sheet around said platen for printing thereon;
- a shaft connected to the frame members upstream of and generally parallel to the platen;
- means for selectively drivingly connecting said shaft to the platen;
- bearing members on said shaft in spaced apart relation;
- sheet holder means including means for attaching to the bearing members; and
- picker means mounted to said shaft for rotation therewith for extracting a sheet from said sheet holder means and delivering the sheet to said means for feeding.

5. The combination of claim 4 wherein the sheet holder means comprises:
- a sheet supply section including a floor means for supporting the stack of sheets;
- an output sheet section;
- means for upwardly biasing the floor means for urging the uppermost sheet of the stack of sheets toward the picker means;
- restraint means located at each corner of the floor closest to the picker means, said restraint means limiting the height of the stack of sheets in the sheet holder means; and
- said restraint means, cooperating with the picker means and floor means comprising means for permitting a single sheet to enter the means for feeding.

6. The apparatus of claim 4 wherein the means for selectively drivingly connecting said shaft to the platen includes gear clutch means responsive to control signals developed in the printer.

7. The combination of claims 4 or 5 wherein the picker means comprises:
- a plurality of generally D shaped rollers, fixedly mounted with their flat sides facing substantially parallel to and spaced apart from the sheet holder means; and
- the means for selectively drivingly connecting the shaft to the platen includes means for rotating the shaft for bringing the rounded portions of the D shaped rollers into contact with the stack of cut sheets.

8. Apparatus for reliable buckle feeding of the topmost sheet in a stack of sheets including:
- a selectively driven shaft having bearing members mounted thereon;
- hopper means for holding a stack of sheets, removably supported by the bearing members,
- said hopper means including a pair of lateral stack support means and upwardly biased bottom stack support means located between said lateral stack support means;
- separator means connected to the shaft for urging the topmost sheet in the stack away from the stack;
- corner restraint means in the hopper means for restraining the topmost sheet,
- said corner restraint means comprising tab members slidingly mounted to said upwardly biased stack support means, and
- adapted to remain in contact with the stack so that a gap created the removal of the topmost sheet is dynamically closed.

9. Apparatus for automatically feeding cut sheets in a stack seriatim to a printer including:

a print station;

an indexable platen;

separator rollers located on a shaft selectively drivably connected to said indexable platen, said shaft having bearing members mounted thereon;

means in said printer for effecting driving connection between said platen and said shaft;

sheet holder means attached to the bearing members on the separator roller shaft;

said sheet holder means including an upwardly biased stack support floor means for urging the stack toward the separator rollers; and corner restraint means slidingly connected to said stack support floor means and adapted to remain in contact with the stack for retaining the stack in contact with said floor means;

said corner restraint means cooperating with said separator rollers for buckling a sheet to be fed.

* * * * *

UNITED STATES PATENT AND TRADEMARK OFFICE

CERTIFICATE OF CORRECTION

PATENT NO. : 4,583,873

DATED : April 22, 1986

INVENTOR(S) : H. M. Parks et al

It is certified that error appears in the above—identified patent and that said Letters Patent is hereby corrected as shown below:

Column 3, line 53, delete "Referring" and substitute --Refer--;
line 53, after 4 insert --,-- and delete "therefor".

Signed and Sealed this

Nineteenth Day of January, 1988

*Attest:*

DONALD J. QUIGG

*Attesting Officer*

*Commissioner of Patents and Trademarks*